US007013867B2

(12) United States Patent
Rammer et al.

(10) Patent No.: US 7,013,867 B2
(45) Date of Patent: Mar. 21, 2006

(54) ENGINE AIR BRAKE DEVICE FOR A 4-STROKE RECIPROCATING PISTON INTERNAL COMBUSTION ENGINE

(75) Inventors: Franz Rammer, Wolfem (AT); Gottfried Raab, Perg (AT); Franz Leitenmayr, Perg (AT)

(73) Assignee: MAN Nutzfahrzeuge AG, (DE)

( * ) Notice: Subject to any disclaimer, the term of this patent is extended or adjusted under 35 U.S.C. 154(b) by 0 days.

(21) Appl. No.: 10/971,548

(22) Filed: Oct. 22, 2004

(65) Prior Publication Data

US 2005/0087170 A1 Apr. 28, 2005

(30) Foreign Application Priority Data

Oct. 24, 2003 (DE) ..... 103 49 641

(51) Int. Cl.
*F02D 9/06* (2006.01)
*F02D 13/04* (2006.01)
*F01L 1/26* (2006.01)

(52) U.S. Cl. ..... 123/321; 123/323

(58) Field of Classification Search ..... 123/320, 123/321, 322, 323, 90.16, 90.22
See application file for complete search history.

(56) References Cited

U.S. PATENT DOCUMENTS

| | | | | |
|---|---|---|---|---|
| 5,036,810 | A * | 8/1991 | Meneely | 123/321 |
| 6,152,104 | A * | 11/2000 | Vorih et al. | 123/322 |
| 6,234,143 | B1 * | 5/2001 | Bartel et al. | 123/321 |
| 6,325,043 | B1 * | 12/2001 | Meistrick et al. | 123/321 |
| 6,474,296 | B1 * | 11/2002 | Cornell et al. | 123/321 |
| 2005/0087170 | A1 * | 4/2005 | Rammer et al. | 123/321 |

* cited by examiner

*Primary Examiner*—Willis R. Wolfe, Jr.
(74) *Attorney, Agent, or Firm*—Robert W Becker & Associates; Robert W Becker

(57) ABSTRACT

An engine air brake device for a 4-stroke reciprocating-piston internal combustion engine is provided and has at least one intake valve and two exhaust valves per cylinder. The exhaust train incorporates a throttling device actuatable for engine deceleration so that an exhaust back pressure builds up in the accumulated exhaust gas upstream of the throttling device and becomes effective in conjunction with an engine-internal braking device associated to only one of the two exhaust valves for each cylinder, the other exhaust valve being controlled conventionally. The engine-internal braking device comprises a control piston installed in the valve bridge and pressed in the direction of the exhaust valve from a control pressure chamber supplied with pressurized oil and possibly also by means of an additional control compression spring.

19 Claims, 5 Drawing Sheets

ENGINE AIR BRAKE DEVICE FOR A 4-STROKE RECIPROCATING PISTON INTERNAL COMBUSTION ENGINE

BACKGROUND OF THE INVENTION

The invention concerns an engine air brake device for a 4-stroke reciprocating-piston internal combustion engine that has at least one intake valve per cylinder and two exhaust valves that are connected to an exhaust train and can be actuated via a valve bridge and a rocker arm that acts on the valve bridge and can be controlled by a camshaft either directly or indirectly via a push rod, each exhaust valve being biased in a closing direction by means of a closing spring, whereby a throttling device is installed in the exhaust train and can be actuated for engine deceleration such that an exhaust back pressure builds up in the accumulated exhaust gas upstream of the throttling device and becomes engine-internally active for engine deceleration in conjunction with a special braking device.

The invention is based on EP 0736672 B1. This reveals a procedure for engine deceleration with a 4-stroke reciprocating piston internal combustion engine which has an engine-internal braking device associated to an exhaust valve. The exhaust valve can be controlled by a rocker arm either directly or indirectly via a push rod. The parts of the braking device are shown as being integrated either in the rocker arm or in the area of the push rod. However, for engines with more than two valves no solution is suggested.

It is therefore an object of this invention to provide an engine air brake device for a 4-stroke reciprocating-piston internal combustion engine which has at least one intake valve and two exhaust valves per cylinder, which engine air brake device makes it possible to realize an engine braking process similar to that described in EP 0736672 B1.

SUMMARY OF THE INVENTION

This object is inventively realized by an engine air brake device characterized by an engine-internal braking device that is associated with only one of the two exhaust valves for each cylinder, the other exhaust valve becoming active conventionally, wherein the engine-internal braking device has a control piston on which the stem of the exhaust valve is supported; the control piston is movably guided axially in a blind bore of the valve bridge and is pressed in the direction of the exhaust stem from a control pressure chamber supplied with pressurized oil and possibly also by means of an additional control compression spring. Pressurized oil is supplied to the control pressure chamber via a valve-bridge-internal oil-supply duct which communicates with a rocker-arm-internal oil-supply duct and in which a check valve permitting passage only in the direction of the control pressure chamber is installed. A relief duct exits the control pressure chamber and emerges on the top side of the valve bridge; its outlet orifice can be closed by a brace doubling as a stop for the valve bridge and for relieving pressure from the control pressure chamber after the valve bridge and for relieving pressure from the control pressure chamber after the valve bridge has risen. Furthermore, the pre-tensioning force of the closing spring allocated to this exhaust valve is proportioned such that during engine deceleration, when the throttling device is in throttling position, an intermediate opening of the exhaust valve is effected because of the exhaust back pressure accumulated in the exhaust gas in conjunction with the pressure pulsations effective therein. In this intermediate opening it is possible to intervene with the engine-internal braking device during each 4-stroke engine cycle in a control-related automatic manner so that after the intermediate opening at the beginning of the $2^{nd}$ stroke the exhaust valve, which is about to close, is intercepted by the approaching control piston charged with oil pressure, and possibly also by means of the control compression spring, is prevented from closing during the $2^{nd}$ and $3^{rd}$ strokes and is kept partially open until its camshaft-controlled opening at the beginning of the $4^{th}$ stroke. The exhaust back pressure is highest when the throttling device is in closing position and can, if necessary, be lowered through the controlled and/or regulated opening of the throttling device to reduce the engine brake output and/or the temperature of engine-internal components to prevent them from overheating. The cross-section of the oil-supply ducts in the rocker arm and valve bridge and the pressure of the oil supplied to the control pressure chamber are adjusted to each other so that during the intermediate opening of the exhaust valve the control pressure chamber which enlarges in volume because of the departing control piston can be filled with pressurized oil almost completely and it is thus possible to keep the exhaust valve in the intercepted partial opening position at the end of the intermediate opening stroke.

It is an important criterion of the invention that the engine-internal braking device is not allocated to both exhaust valves per cylinder, which would be difficult to realize for reasons of space, but that it was, from the start, designed so that it is effective only in conjunction with one of the two exhaust valves per cylinder, the other exhaust valve, however, being actuated in the normal i.e. conventional manner.

The other features of this invention are subordinated to this decisive feature because they are designed to make effective the engine-internal braking device allocated to only one of the exhaust valves.

It is apparent that the engine air brake device as per this invention can be realized with a few components which can be produced at low cost. Engine deceleration is effected in a control-related automatic manner without intervention from the outside only as a function of the exhaust back pressure in the shut-off exhaust train and provenly achieves a very high engine braking output.

BRIEF DESCRIPTION OF THE DRAWINGS

In the following the solution provided by this invention is explained in greater detail with the aid of the drawings, in which.

DESCRIPTION OF SPECIFIC EMBODIMENTS

Figure 1:
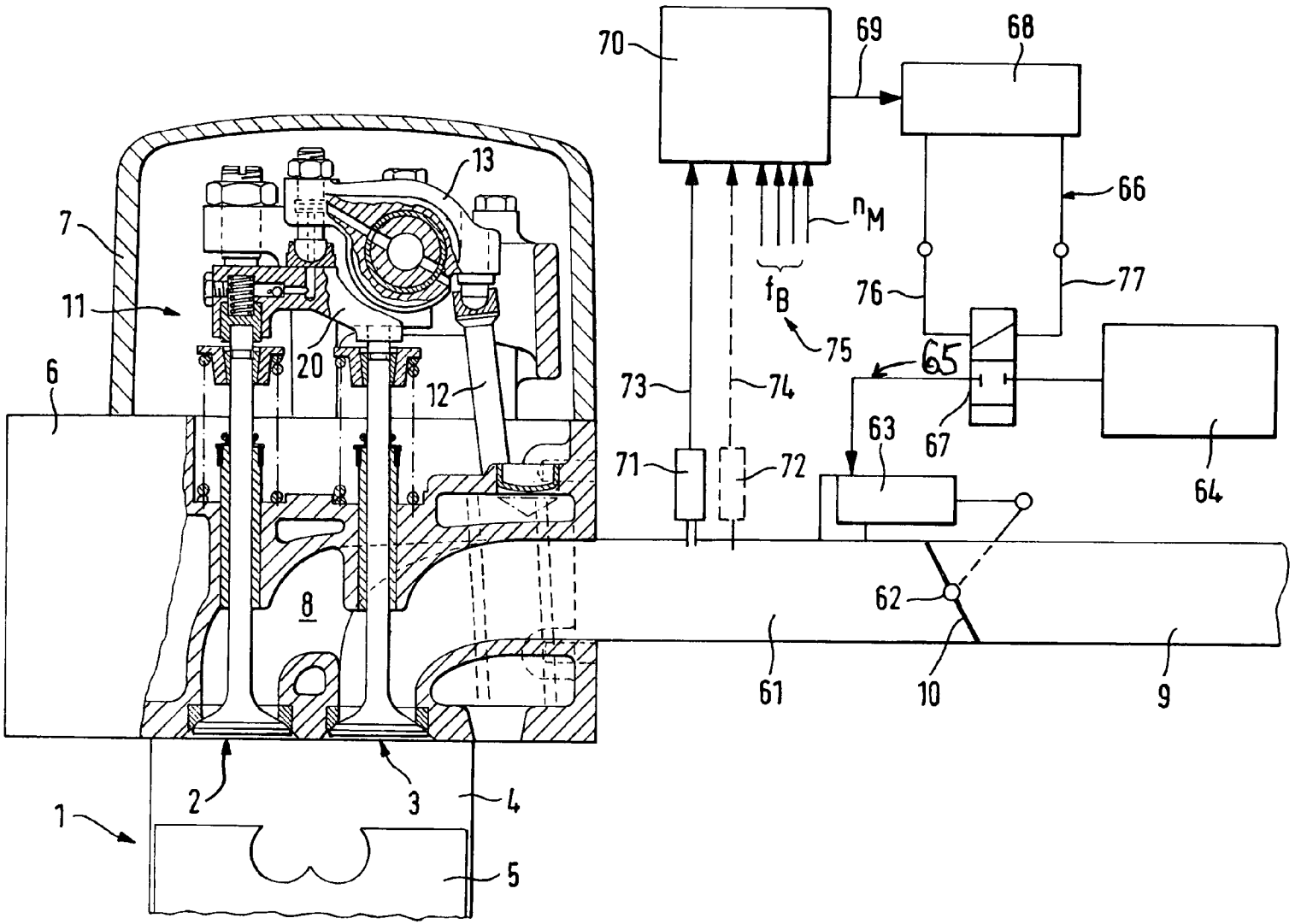
FIG. 1 A schematic diagram of a 4-stroke reciprocating-piston internal combustion engine and its exhaust train with a throttling device and a principle diagram for the possible control of said throttling device.
Figure 2:
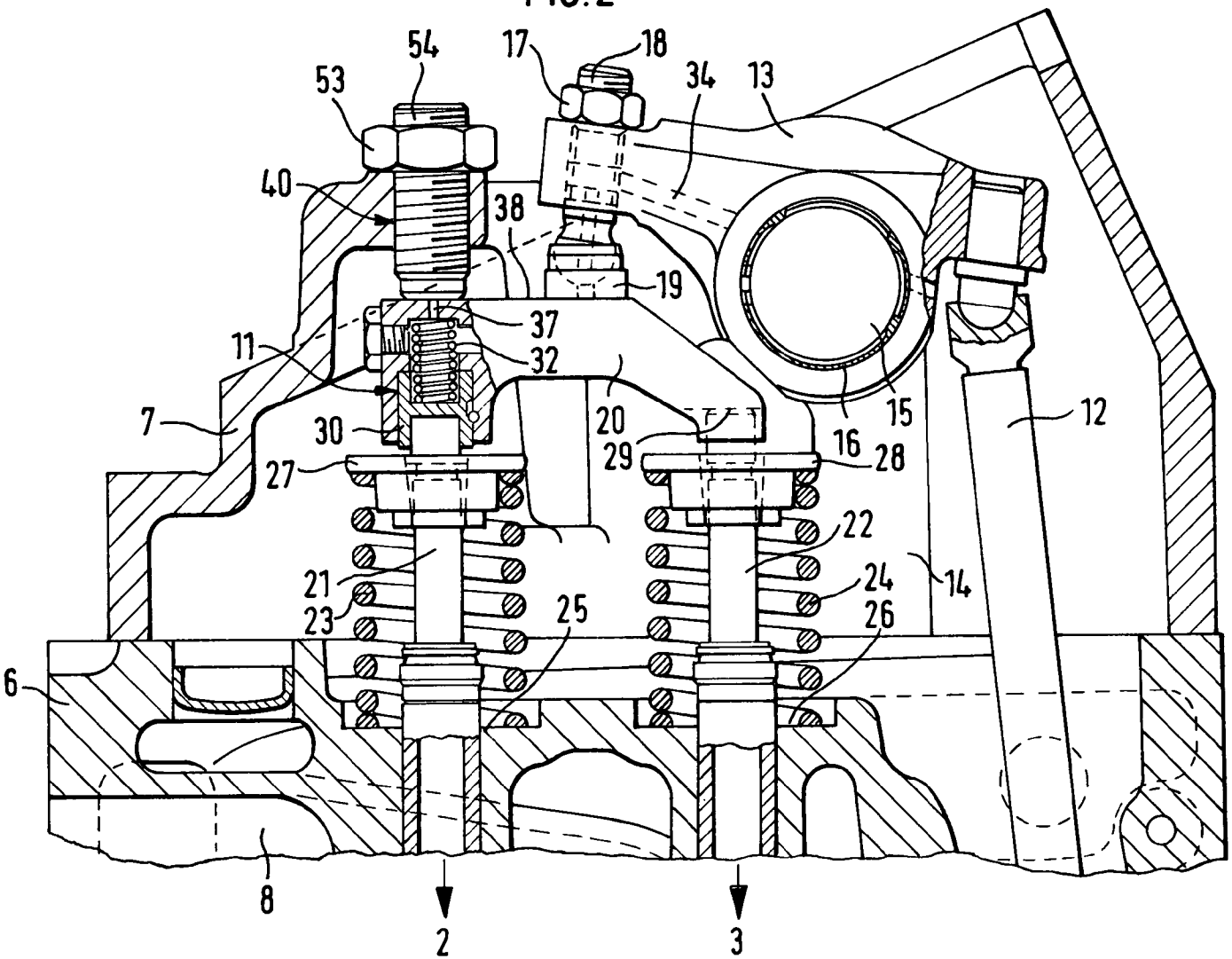
FIG. 2 A cross-section through a four-valve 4-stroke reciprocating-piston internal combustion engine in the area of the exhaust valves and their control feature, with a first implementation example of the engine-internal braking device as per this invention.

FIG. 1 shows a section of a 4-stroke reciprocating-piston internal combustion engine which has at least one intake valve (not shown) and two exhaust valves 2, 3 per cylinder. The combustion chamber of cylinder 1 is designated with 4, the piston working in cylinder 1 is designated with 5, a cylinder head with 6 and a cylinder cover with 7. The exhaust ports 8 of cylinder 1 discharge into one or several exhaust manifolds and, together with the latter, form a part of the exhaust train 9. In the exhaust train 9 a throttling device 10 is installed as close to the engine as possible. This device may be provided in the form of a butterfly valve or a flat-seat valve or a slide. In most cases a butterfly valve is used. The throttling device 10 together with its control and/or regulating organs (which will be described in greater detail later on) constitute a part of the engine air brake device as per this invention and serve for at least partially shutting off the exhaust train during engine braking operations and, consequently, for accumulating exhaust gas upstream of the air brake device. Another part of the engine air brake device is an engine-internal braking device 11 designed as per this invention and also described in greater detail later on. The intake and exhaust valves can be controlled by a camshaft-(not shown here). If the camshaft is top-mounted it will act directly on the rocker arms. If, however, it is bottom-mounted it will act on the rocker arms indirectly via push rods. FIG. 2 shows the version with the bottom-mounted camshaft in the area of the control feature for the two exhaust valves of a cylinder. The depicted push rod 12 is supported on the camshaft and acts on a rocker arm 13 pivotably supported with sliding bearings 16 on a bearing shaft 15 in a bearing block 14 on the cylinder head 6. The rocker arm 13 in turn acts on a valve bridge 20 via an adjustable screw bolt 18 secured e.g. by a nut 17 and provided with a support cap 19 located on the free end of the screw bolt 18 by means of a ball bearing. This valve bridge 20 serves for controlling the two exhaust valves 2, 3 of a cylinder 1, the axes of the exhaust valves being arranged parallel to each other. Each of these exhaust valves is, with its stem 21 and 22, movably mounted axially and charged with a certain pre-tensioning force in closing direction by means of a closing spring 23, 24 whose one end is supported on a cylinder head face 25 and 26 and whose other end is supported on a spring plate 27 and 28 on the exhaust valve stem 21 and 22. Each of the closing springs 23 and 24 may be provided in the form of one spiral spring or of two spiral springs coaxially arranged to each other.

According to one criterion of the invention the engine-internal braking device 11 is allocated only to one (2) of the two exhaust valves 2, 3 per cylinder, whereby the other exhaust valve 3 is effective and actuated in the normal i.e. conventional manner and is, consequently, supported conventionally with the upper end of its stem on the underside 29 of the valve bridge 20.

In this invention the engine-internal braking device 11 allocated to the one exhaust valve 2 comprises a control piston 30 on which the upper end of the stem 21 of the exhaust valve 2 is supported. The control piston 30 is movably guided in a blind bore 31 in the valve bridge 20 in an axial and low-leakage manner and is pressed in the direction of the exhaust valve stem 21 from a control pressure chamber 33 supplied with pressurized oil and possibly also by means of an additional control compression spring 32. Pressurized oil is supplied to the control pressure chamber 33 via an oil-supply duct 34 provided in the rocker arm 13 and its screw bolt 18 with support cap 19 and via an oil-supply duct 35 provided in the valve bridge 20 and communicating with the oil-supply duct 34. A check valve 36 permitting passage of oil only in the direction of the control pressure chamber 33 is installed in the valve-bridge-internal oil-supply duct 35. Pressurized oil is supplied to the rocker arm 13 from the outside either via a supply line to a duct in the rocker-arm bearing pin 15 and ducts in the sliding bearing 16 or via a supply line to the push rod 12 and a push-rod-internal duct with which the rocker-arm-internal oil-supply duct 34 communicates.

A relief duct 37 exits the control pressure chamber 33 and emerges on the top side 38 of the valve bridge 20; its outlet orifice 39 provided there can be closed by a brace 40 doubling as a stop for the valve bridge 20 and for relieving pressure from the control pressure chamber 33 after the valve bridge 20 has risen.

Under normal operating internal-combustion engine conditions, i.e. when no engine deceleration action is initiated, both exhaust valves 2, 3 of a cylinder 1 are actuated synchronously via the valve bridge 20, which means that within each 4-stroke engine cycle they are opened towards the end of the $3^{rd}$ stroke (power or expansion stroke), are kept open during the $4^{th}$ stroke (exhaust stroke) and are then closed again towards the beginning of the next $1^{st}$ stroke (intake stroke).

Figure 9:
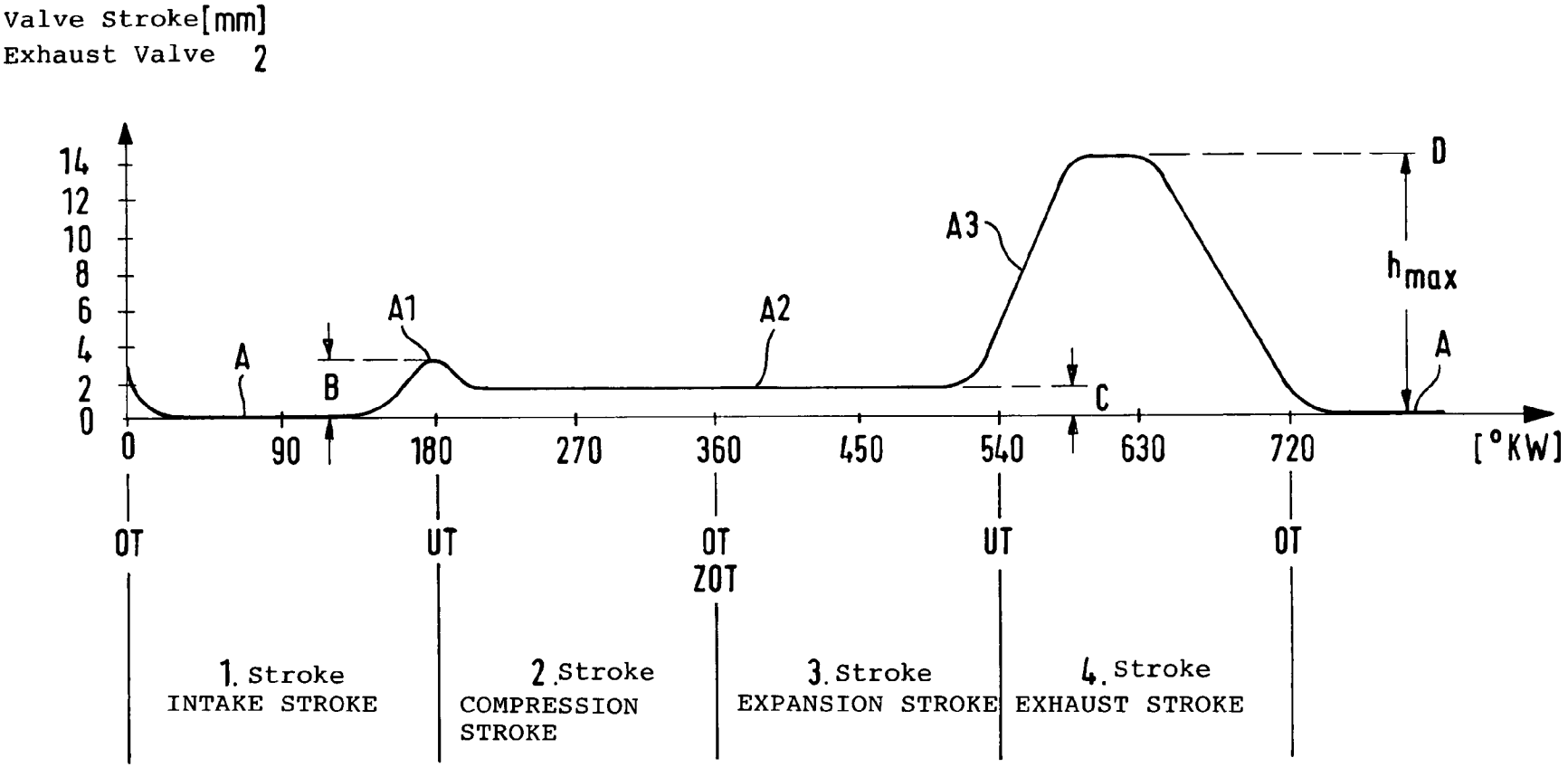
FIG. 9 A diagram showing the stroke of the exhaust valve during braking operation, the exhaust valve being the one to which the engine-internal braking device as per this invention is allocated.

In the engine air brake device as per this invention the pre-tensioning force of the closing spring 23 of that exhaust valve 2 to which the engine-internal braking device 11 is allocated is proportioned such that during engine deceleration when the throttling device 10 is in throttling position an intermediate opening of the relevant exhaust valve 2 is effected, namely —as can be learned from FIG. 9—at the end of the $1^{st}$ stroke (intake stroke) of every 4-stroke cycle, because of the exhaust back pressure accumulated in the exhaust gas in conjunction with the pressure pulsations. In this intermediate opening of the exhaust valve 2 an intervention with the engine-internal braking device 11 as per this invention is made in a control-related automatic manner so that after the intermediate opening at the beginning of the $2^{nd}$ stroke (compression stroke) the exhaust valve 2, which is about to close, is intercepted and prevented from closing during the $2^{nd}$ and $3^{rd}$ strokes and is kept partially open until its camshaft-controlled opening at the beginning of the $4^{th}$ stroke. The exact procedures, also within the engine-internal engine brake device 11, will be explained in greater detail later on.

During engine deceleration the exhaust back pressure is highest when the throttling device 10 is in closing position. However, it may be purposeful and sensible to reduce the exhaust back pressure effective during engine deceleration through the controlled and/or regulated opening of the throttling device 10 away from its closing position in order to purposefully reduce the engine brake output and/or the temperature of engine-internal components so as to prevent them from overheating and/or coking.

In addition, within the engine-internal braking device 11 as per this invention the cross-section of the oil-supply ducts 34, 35 and the oil pressure effective therein and in the control pressure chamber 33 are adjusted to each other so that during said intermediate opening of the exhaust valve 2 the control pressure chamber 33, which enlarges in volume because of the departing control piston 30, can be filled with pressurized oil almost completely and that it is thus ensured that the exhaust valve 2 is then kept in the intercepted partial opening position via the control piston 30 blocked by oil from the control compression chamber 33 towards the end of the intermediate opening stroke.

In the following, details and implementation variants of the solution as per this invention are described in greater detail.

Figure 3:
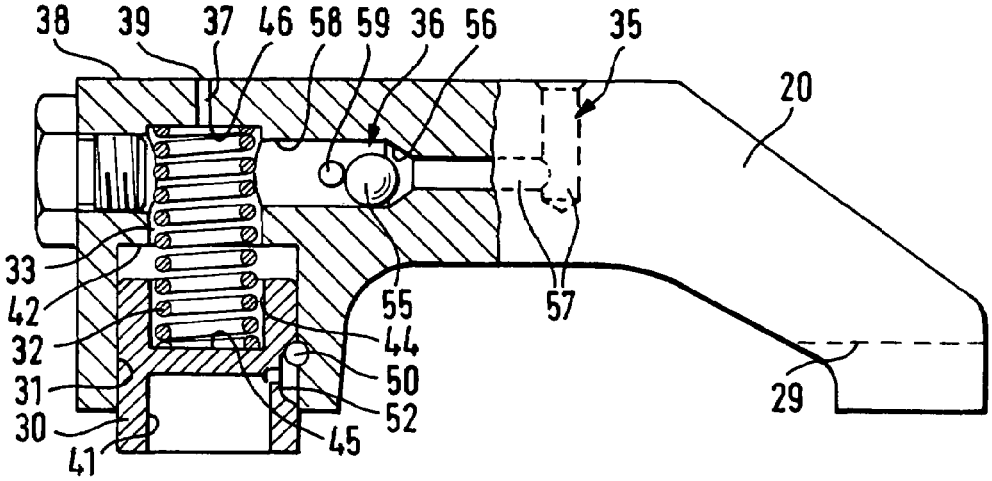
FIG. 3 The valve bridge and further parts of the engine-internal braking device as per FIG. 2 in a detailed view and in cross-section.
Figure 4:
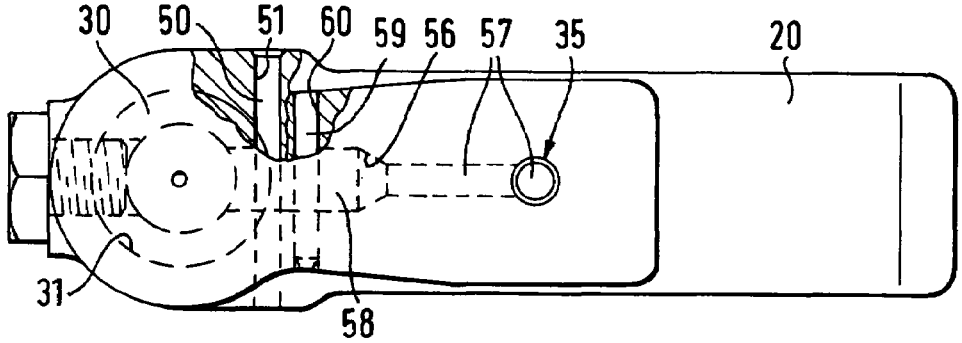
FIG. 4 The valve bridge as per FIGS. 2 and 3 as viewed from above.
Figure 5:
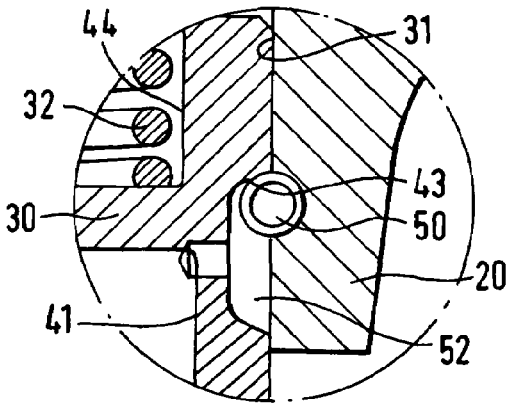
FIG. 5 An enlarged section from the view shown in FIG. 3.
Figure 6:
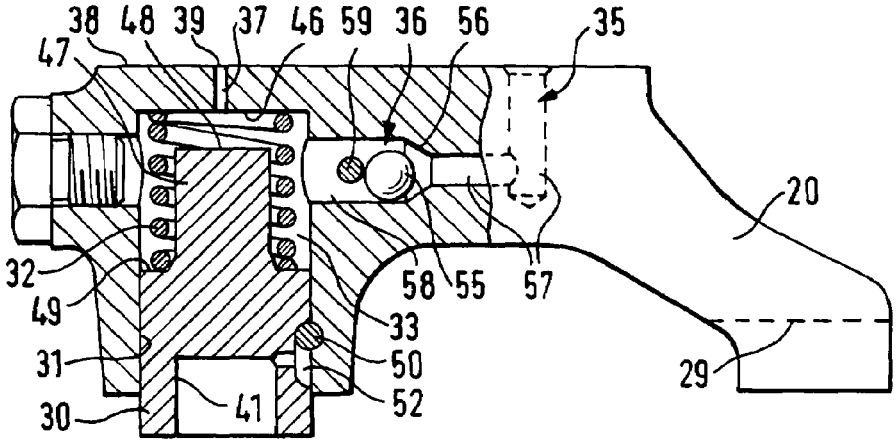
FIG. 6 A further implementation example of a valve bridge and further parts of the engine-internal braking device in a detailed view and in cross-section.
Figure 7:
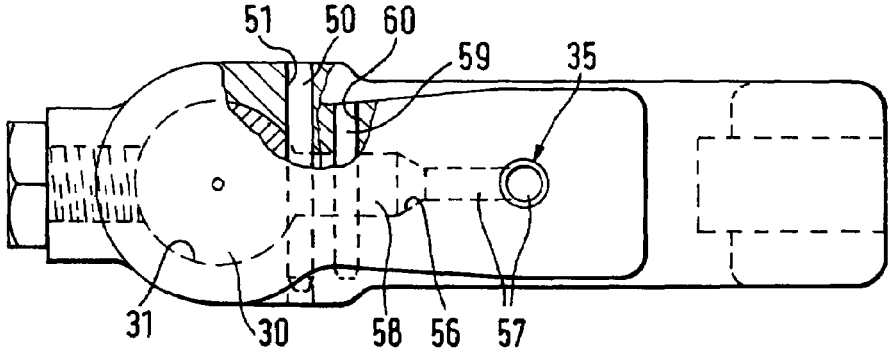
FIG. 7 The valve bridge as per FIG. 5 as viewed from above.
Figure 8:
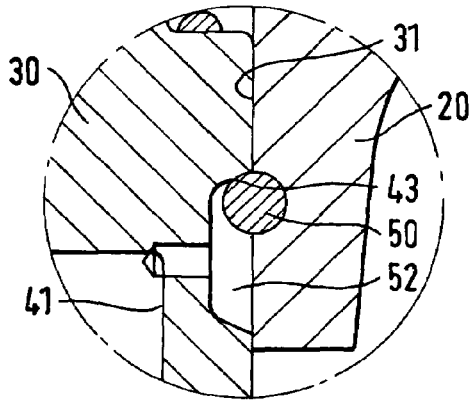
FIG. 8 An enlarged section from the view in FIG. 6.

The control piston 30 of the engine-internal braking device 11 has a blind bore 41 at the front—towards the exhaust valve 2—, with which the control piston 30 overlaps the upper end of the exhaust-valve stem 21 in a cap-like manner and with play and is thus coupled with the exhaust valve 2. In the valve-bridge-internal blind bore 31 the control piston 30 is movably arranged between two stops in a stroke-limited manner. In the case of the example as per FIGS. 3 to 5 the upper stop 42 specifying the retracted basic position is provided in the form of a ring-type shoulder face in the transition area between two sections of the blind bore 31, which sections have different diameters, whereby the section with the larger diameter holds the control piston 30 and the section with the smaller diameter forms the control pressure chamber 33 and also holds the control compression spring 32 in a laterally guided manner. In this implementation example the control compression spring 32 is supported in a rear blind hole 44 in the control piston 30 in a centred manner and is supported there on the bottom 45 of the rear blind hole 44. The other end of the control compression spring 32 is supported on the bottom 46 of the valve-bridge-internal blind bore 31. In the case of the example as per FIGS. 6 to 8, however, the upper stop 42 specifying the retracted basic position for the control piston is provided in the form, of the bottom 46 of the valve-bridge-internal blind bore. In this case a coaxial pin 47 is arranged on the rear side of the control piston 30, with the rear face 48 of which pin 47 the control piston contacts the bottom 46 of the blind bore 31. The bottom 46 is provided with a relief duct 37 which is preferably arranged in center position so that the pin 47 also has the additional function that in each $4^{th}$ engine stroke, immediately after the start of the camshaft-controlled opening-stroke movement of the valve bridge 20 and the resultant lifting of said valve bridge 20 from the brace 40, the quantity of pressurized oil ejected via the relief duct 37 for the purpose of relieving pressure from the control pressure chamber 33 is limited because the relief duct 37 is closed again from within by the pin 47 of the control piston 30 which returns to its basic position immediately. This limits the oil loss in the control pressure chamber 33 and ensures that the oil pressure in the control pressure chamber 33 remains high. In this case the control compression spring 32 is supported on a ring-type shoulder face 49 on the control piston 30 and is centered by the coaxial pin 47 on the control piston 30.

In the two implementation examples as per FIGS. 3 to 5 and FIGS. 6 to 8 the lower stop 43 specifying the farthest extended position of the control piston is realized by a transverse pin 50, which is pressed into a transverse bore 51 in the valve bridge 20, laterally protrudes into the clear cross-section of the blind bore 31 and penetrates into an outer recess 52 on the control piston 30, the upper limit wall of the recess 52 serving as the stop 43 and, together with the transverse pin 50, limiting the extension stroke of the control piston 30.

The brace 40 for the valve bridge 20 is provided in the form of a stud bolt 54 which is fixed in the cylinder cover 7, e.g. by a counter nut, and can be adjusted in respect of its stop position. The relief duct 37 which can, as a result, be shut off and opened on the outlet side is provided preferably in the form of a constriction bore which runs coaxially from the blind bore 31 to the upper side 38 of the valve bridge 20 and whose diameter is considerably smaller than the smallest cross-section of the oil-supply duct 35 in the valve bridge 20.

The check valve 36 has a ball 55 as control organ and the associated valve seat is designed as a conical transition area 56 between two oil-supply-duct sections 57, 58 with different diameters, whereby the ball 55 is arranged in the oil-supply-duct section 58 with the larger diameter where its opening stroke is limited by a stop 59. To limit the stroke of the check-valve ball 55 e.g. a stop pin passing through the oil-supply-duct section 58 in transverse direction and pressed into a transverse bore 60 in the valve bridge 20 is provided.

The cross-section of the oil-supply duct 34 in the rocker arm 13 is the same as or is preferably larger than that of the adjoining oil-supply duct 35 in the valve bridge 20. The smallest cross-section of the oil-supply duct 35 is within the valve bridge 20 in the area of the check valve 36, namely in the area of the ring or annular gap round its ball 55 in the oil-supply-duct section 58. Generally speaking, the check valve 36 is to be positioned as close to the control pressure chamber 33 as possible.

The effective pre-tensioning force of the closing spring 23 of the exhaust valve 2 is higher than the effective pre-tensioning force of the valve-bridge-internal control compression spring 32. The theoretical background of the engine air brake device as per this invention is set out at the end of this description.

Generally speaking, the components of the engine-internal braking device 11 and the pressure of the pressurized oil supplied to the control pressure chamber 33 are designed such that the exhaust valve 2 can be intercepted and kept in a position C (see FIG. 9) during engine deceleration after its intermediate opening to an opening position B (see FIG. 9), the intermediate opening being effected by the exhaust back pressure, the distance of position C to the closing position of the exhaust valve (2) being approximately ⅕ to 1/20 of the full opening stroke of the exhaust valve $h_{max}$=A→D (see FIG. 9).

If the internal combustion engine is equipped with a turbocharger, as far as possible the throttling device 10 in the exhaust train 9 should, in respect of the direction of the flow of exhaust gases, be arranged upstream of the turbine of the turbocharger. Generally speaking, the volume of that section 61 of the exhaust train 9 that can be shut off by means of the throttling device 10 ought to be as small as possible, which means that the throttling device 10 ought to be arranged as close to the engine as possible, e.g. at the outlet of one or several combined exhaust manifolds and be spatially upstream of the turbine of the turbocharger.

The control feature for the throttling device 10 can be realized as is also schematically shown in FIG. 1. There, the throttling device 10 is designed as a butterfly valve and installed in the exhaust train 9 where its shaft 62 is pivotably supported. A pilot motor 63 is provided to adjust the butterfly valve 10. This motor may be provided in the form of an electric motor or an adjusting cylinder that can be actuated hydraulically or pneumatically. In the example shown the pilot motor 63 is a pneumatically actuated adjusting cylinder which can be supplied with compressed air via a compressed-air line 65 connected to a compressed-air supply device 64. An output unit 66 is allocated to the pilot motor 63 and, in the example shown, comprises an electromagnetic shut-off/passage valve 67 and an electric switching organ 68 for actuating the valve 67. This output unit 66 receives its commands via a control line 69 from an electronic control and/or regulating unit 70. 71 designates a pressure sensor which records the exhaust back pressure upstream of the butterfly valve 10. Instead of the pressure sensor 71 or in addition to it a temperature sensor 72 may be provided which records the exhaust-gas temperature upstream of the butterfly valve 10. These measured pressure and/or temperature signals, if necessary also speed signals nM from the internal combustion engine and measured temperature signals $t_B$ from temperature-monitored engine-internal components such as injection nozzles, are supplied via signal lines 73, 74, 75 to the control and/or regulating unit 70 which uses them as a basis for actuating the butterfly valve 10. The control and/or regulating unit 70 comprises, for example, an input and output periphery, a microprocessor and data and program memories, which components are connected with one another via a data bus system. In the data memories, maps and operating data for the operation control of the internal combustion engine both in pulling and in braking modes are saved. As a result, the control and/or regulating unit 70 controls the operation of the internal combustion engine by means of the program saved in the program memory and with the aid of the maps and operating data. The control operation may be effected during engine deceleration either by opening/closing the butterfly valve 10 or in the sense of a sensitive adjustment of the butterfly valve 10. The control and/or regulating unit 70 sends its commands via line 69 to the switching organ 68 which is connected via the switching lines 76, 77 with the shut-off/passage valve 67. To generate during engine brake operation a braking power which is smaller than the maximum possible braking power or to prevent engine-internal components from overheating, the throttling device 10 is correspondingly adjusted as a function of data-based, specified time intervals or of measured component temperatures and/or on the basis of other data, for example from the operation of the vehicle which contains the engine. In the case of an internal combustion engine installed in a vehicle, particularly in a commercial vehicle such as a truck or bus, this control function for the braking output may be integrated into an electronically controlled braking strategy which optimally co-ordinates the use of all brakes (service brakes, retarder, engine brake) in the vehicle.

The following describes in greater detail the combined action of the parts of the engine air brake device as per this invention during engine deceleration.

When an engine braking action is initiated the throttling device 10 is brought into a closing position through commands from the control/regulating unit 70 so that upstream of the throttling device 10 pressure increases with the corresponding exhaust back pressure. The pressure waves created when exhaust gas is pushed out of adjoining cylinders 1 superimpose themselves over the stationary exhaust back pressure and, owing to the positive pressure difference, effect an intermediate opening of each of the exhaust valves 2 allocated to an engine-internal braking device 11—see phase A1 in the diagram in FIG. 9—, which intermediate opening takes place at the end of the $1^{st}$ stroke (intake stroke). In this intermediate opening of the exhaust valve 2, which intermediate opening is effected independently of the camshaft control function, an intervention as per this invention is made during the braking operation in a control-related automatic manner. In this intervention, after the intermediate opening the exhaust valve 2, which is about to close, under the action of its closing spring 23 is positively intercepted by the associated engine-internal braking device 11 and is kept partially open with the aid of such braking device 11 throughout the entire compression stroke and power stroke—see phase A2 in the diagram as per FIG. 9. During this action the following processes occur in the engine-internal braking device.

At the beginning of the $1^{st}$ intake stroke the exhaust valve 2 is in closing position A. In its blind bore 31 the control piston 30 of the engine-internal braking device 11 is set to contact the stop and acts as a mechanical buffer, whereby it is pressed into this retracted basic position by the closed exhaust valve 2.

Towards the end of the $1^{st}$ stroke the exhaust-back-pressure-induced intermediate opening of the exhaust valve 2 is effected with a valve stroke A->B achieved at the end of phase A1 (see diagram in FIG. 9). Following the intermediate opening movement of exhaust valve 2, the control piston 30 is pushed up by the oil pressure in the control pressure chamber 33 and the force of the possibly fitted control compression spring 32 and is extended to its stop-related farthest interception position. As the control piston extends, the control pressure chamber 33 enlarges in volume and is immediately filled with pressurized oil via the oil-supply ducts 34, 35, whereby after the control pressure chamber 33 has been completely filled—because of the blocking check valve 36 and the relief duct 37 shut off by the brace 40—the control piston 30 in its extended interception position is hydraulically blocked in the valve bridge 20. During the intermediate opening the exhaust valve 2 travels ahead of the stroke of the control piston 30 with a longer stroke. In the transition from phase A1 to phase A2 (see diagram in FIG. 9) the exhaust valve 2 again moves in the closing direction, but is intercepted after having traveled only a short distance B^C on its way back at the beginning of the $2^{nd}$ stroke (compression stroke) by the control piston 30 hydraulically blocked in the valve bridge 20. This intercepted position is kept throughout the entire phase A2, i.e. throughout the entire remaining $2^{nd}$ stroke (compression stroke) and the following $3^{rd}$ stroke (expansion stroke).

Only then, when at the end of the $3^{rd}$ stroke (expansion stroke) camshaft-related control of the exhaust valve 2 is resumed via the associated control cam on the camshaft, if necessary via the push rod 12, the rocker arm 13 and the valve bridge 20, is this previous hydraulic blocking of the control piston 30 lifted, for as soon as the valve bridge 20 is moved in the direction of "opening of exhaust valve", it rises from the brace 40. As a result, the relief duct 37 is opened and pressurized oil can flow through the duct 37 from the control pressure chamber 33, which is now no longer blocked hydraulically, into the area of the cylinder cover 7, an action which is also supported by the control piston 30 pressed in the direction of its retracted basic position by the exhaust valve 2 moved in closing direction by its closing spring 23.

As soon as the control piston 30 is again fully pressed to the stop position in the valve-bridge-internal blind bore 31, it again acts only as a purely mechanical buffer on the valve bridge 20, via which in phase A3 (see diagram in FIG. 9) during the $4^{th}$ (exhaust stroke) when the engine is in deceleration mode the exhaust valve 2 is then opened—synchronously to the second exhaust valve 3—until the full exhaust valve stroke D is reached, the holding and reclosing of which valves 2, 3 is controlled by the corresponding cam on the camshaft and via the rocker arm 13. At the end of the $4^{th}$ stroke (exhaust stroke) during engine deceleration the valve bridge 20 resumes the position shown in the FIGS. 1 and 2, from which position the next braking cycle is performed in the manner described above.

The following provides some data on the theoretical background of the engine air brake device as per this invention: As was already mentioned, the intermediate opening of the exhaust valve 2 during an engine deceleration phase is prompted by the pressure waves being pushed out of adjoining cylinders 1 and flowing into the exhaust train 9. To calculate the movement of the exhaust valve 2 during the intermediate opening, the following movement equation is used:

$$mv\cdot\ddot{y}+d\cdot\dot{y}+(c+f)\cdot y+F1-Fk-Ava\cdot pa+Avz\cdot pz=0$$

In respect of the exhaust valve 2 described, this means:

mv=Reduced valve mass (mass participating in the intermediate opening)

ÿ=Valve acceleration d=Speed-proportionate damping of the exhaust valve 2 y=Valve speed c=Spring rate of the closing spring 23 f=Spring rate of the optional control compression spring 32 y=Valve stroke

F1=Pretensioning force of the closing spring 23

Fk=Pretensioning force acting on the control piston 30 (oil pressure and possible control compression spring 32)

Ava=Valve face on exhaust side pa=Pressure in the exhaust train 61

Avz=Valve face facing the cylinder pz=Pressure in cylinder 1 pl Pressure in intake pipe (charge-air pressure)

From this the pre-tensioning force F1 of the closing spring 23 for exhaust valve 2 and of the control compression spring 32 is calculated as follows:

$$Ava\cdot pa-Avz\cdot pz-mv\cdot\ddot{y}-d\cdot\dot{y}-(c+f)\cdot y=F1-Fk$$

Within the context of the permissible design range, which results from the calculation of the valve gear dynamics, to ensure that the engine air brake device functions properly, the pretensioning force F1 of the closing spring 23 for exhaust valve 2 is to be designed so that on the basis of the exhaust back pressure accumulated in the exhaust gas when the throttling device 10 is closed the exhaust valve 2 safely opens intermediately. However, F1 should not be too low either, as otherwise the air flow rate and the exhaust back pressure will drop, which would reduce the internal cooling effect for the internal combustion engine in braking operation and also the braking output.

Since at the beginning of the intermediate opening of the exhaust valve 2 the valve stroke y and, consequently, y and y are 0, the equation at this point in time is reduced to:

$$Ava\cdot pa-Avz\cdot pz=F1-Fk$$

Since it can be assumed by approximation that the valve face (facing the cylinder) of the exhaust valve 2 roughly corresponds to the circular area with the theoretical valve seat diameter (Avm) and in conventional exhaust valves the stem cross-section is approx. 4% of Avm, the equation can be approximated as follows:

$$Avm\cdot(pa\cdot 0.96-pz)\ll F1-Fk$$

Since the intermediate opening of the exhaust valve 2 is induced by the exhaust back pressure at the end of the induction stroke, pz may be substituted with the charge-air pressure (in braking operation this is usually identical with the atmospheric pressure).

With pa as the required exhaust back pressure in the lower speed range and a factor K for the dynamic pressure increase (the exhaust valve 2 is to be pressed open only by the pressure waves generated by adjoining cylinders), the pretensioning force F1 of the closing spring 23 of the exhaust valve is, consequently, designed as follows:

$$F1=Avm\cdot(K\cdot pa\cdot 0.96-pi)+Fk \text{ where } K=1.2\pm 0.2$$

With the engine air brake device as per this invention, which can be realized with comparably inexpensive and simple means even in an internal combustion engine which has two exhaust valves per cylinder, a very high engine braking output can be achieved in engine deceleration.

The specification incorporates by reference the disclosure of German priority document 103 49 641.6 filed Oct. 24, 2003.

The present invention is, of course, in no way restricted to the specific disclosure of the specification and drawings, but also encompasses any modifications within the scope of the appended claims.

What is claimed is:

1. An engine air brake device for a 4-stroke recriprocating-piston internal combustion engine that has at least one intake valve per cylinder and two exhaust valves that are connected to an exhaust train and can be actuated via a valve bridge and a rocker arm that acts on said valve bridge and can be controlled by a camshaft either directly or indirectly via a push rod, each exhaust valve being biased in a closing direction by means of a closing spring, whereby a throttling device is installed in said exhaust train and can be actuated for engine deceleration such that an exhaust back pressure builds up in accumulated exhaust gas upstream of said throttling device and becomes engine-internally active for engine deceleration in conjunction with a braking device, which comprises:

an engine internal braking device associated with only one of said two exhaust valves for each cylinder, wherein said braking device is provided with a control piston against which a valve stem of said one exhaust valve is supported, wherein said control piston is moveably guided axially in a blind bore of said valve bridge and is adapted to be pressed in a direction of said valve stem from a control pressure chamber that is supplied with pressurized oil, and optionally from an additional control compression spring, wherein pressurized oil is supplied to said control pressure chamber via a duct that is provided in said valve bridge and communicates with a duct in said rocker arm, wherein a check valve is disposed in said duct of said valve bridge and permits flow only in a direction toward said control pressure chamber, wherein a relief duct exits said control pressure chamber and opens out on an upper side of said valve bridge, wherein a brace, which doubles as a stop for said valve bridge, is provided for closing off an outlet orifice of said relief duct and for opening said outlet orifice for relieving pressure from said control pressure chamber after raising of said valve bridge, wherein a pre-tensioning force of said closing spring that is associated with said one exhaust valve is such that during engine deceleration when said throttling device is in a throttling position, an intermediate opening of said one exhaust valve is effected due to exhaust back pressure accumulated in the exhaust gas in conjunction with pressure pulsations effective therein, wherein in such intermediate opening it is possible to intervene with said engine-internal braking device during each 4-stroke engine cycle in a control-related automatic manner so that after the intermediate opening at the beginning of a second stroke said one exhaust valve, which is about to close, is intercepted by the approaching oil-pressure-charged control piston, is prevented from closing during second and third strokes, and is kept partially open until a camshaft-controlled opening at the beginning of a 4th stroke, wherein the exhaust gas pressure is highest when said throttling device is in a closing position and can, if necessary, be lowered through a controlled and/or regulated opening of said throttling device to reduce engine brake output and/or the temperature of engine-internal components, and wherein a cross-section of the oil-supply ducts, and a pressure of the oil supply to said control pressure chamber, are coordinated with each other such that during an intermediate opening of said one exhaust valve, said control pressure chamber, which enlarges in volume due to the departing control piston, can be filed with pressurized oil at least almost completely, thus ensuring that said one exhaust valve is kept in an intercepted partial opening position towards the end of an intermediate opening stroke.

2. An engine air brake device according to claim 1, wherein a front side of said control piston is provided with blind bore via which said control piston overlaps an upper end of said stem of the associated one exhaust valve in a cap-like manner and with play.

3. An engine air brake device according to claim 1, wherein one end of said control compression spring is supported on a base of a rear blind hole in said control piston, and wherein the other end of said compression spring is supported on a base of said blind bore in said valve bridge.

4. An engine air brake device according to claim 1, wherein said brace or said valve bridge is in the form of a stud bolt that is fixed in a cover of said cylinder and can be adjusted with respect to a stop position thereof.

5. An engine air brake device according to claim 1, wherein a cross-section of said oil-supply duct in said rocker arm is the same as or larger than a cross-section of said oil-supply duct in said valve bridge.

6. An engine air brake device according to claim 1, wherein said relief duct is in the form of a constriction bore that extends coaxially from a base of said blind bore in said valve bridge to an upper side of said valve bridge, and wherein a diameter of said relief duct is considerably smaller than a smallest cross-section of said oil-supply duct in said valve bridge.

7. An engine air brake device according to claim 1, wherein the effective pre-tensioning force of said valve spring of said one exhaust valve is higher than an effective pre-tensioning force of said control compression spring acting on said one exhaust valve via said control piston.

8. An engine air brake device according to claim 1, wherein the components of the engine-internal braking device, and the pressure of the pressurized oil supply to said control pressure chamber, are designed such that said one exhaust valve can be intercepted and kept in a first position during engine deceleration after its intermediate opening effected by the exhaust back pressure, and wherein the distance of said first position to the closing position of said one exhaust valve is approximately ⅕ to 1/20 of the full opening stroke of said one exhaust valve.

9. An engine air brake device according to claim 1, wherein said throttling device in said exhaust train is disposed spatially upstream of a turbine of a turbocharger.

10. An engine air brake device according to claim 1, wherein a volume of a section of said exhaust train that can be shut off by means of said throttling device is as small as possible, for which purpose said throttling device is disposed as close to said engine as possible, namely at an outlet of one or more combined exhaust manifolds, and is disposed spatially upstream of a turbine of a turbocharger.

11. An engine air brake device according to claim 1, wherein, in order to generate a braking power that is smaller than a maximum possible braking power during engine brake operation, and/or to prevent engine-internal components from overheating, said throttling device is controlled as a function of specific time intervals or of measured component temperatures and/or on the basis of data obtained from operation of a vehicle containing said engine, and wherein in the case of a vehicle engine, the control function for said throttling device is adapted to be integrated into an electronically controlled braking strategy that optimally co-ordinates the use of all brakes of said vehicle.

12. An engine air brake device according to claim 1, wherein said check valve is provided with a ball as a control organ, and an associated valve seat is in the form of a conical transition area between two oil-supply-duct sections having different diameters, and wherein said ball is disposed in that oil-supply-duct section having the larger diameter, where an opening stroke thereof is limited by a stop.

13. An engine air brake device according to claim 12, wherein said stop for limiting the opening stroke of said check-valve ball is in the form of a stop pin that passes through said oil-supply-duct having the larger diameter in a transverse direction and is pressed into a transverse bore said valve bridge.

14. An engine air brake device according to claim 12, wherein a smallest cross-section of said oil-supply duct in said valve bridge is disposed in the area of an annular gap about said ball in said valve bridge.

15. An engine air brake device according to claim 1, wherein said control piston is moveably disposed in said blind bore of said valve bridge between two stops in a low-leakage and stroke-limited manner.

16. An engine air brake device according to claim 15, wherein an upper one of said stops, which prescribes a retracted basic position for said control piston, is in the form of a shoulder face disposed in a transition area between two sections of said blind bore that have different diameters, wherein the section with the larger diameter holds said control piston, and wherein the section with the smaller diameter forms the control pressure chamber and holds said control compression spring.

17. An engine air brake device according to claim 15, wherein a lower one of said stops, which prescribes the farthest extended position of said control piston, is realized by a transverse pin that is pressed into a transverse bore in said valve bridge, wherein said transverse pin protrudes laterally into a clear cross-section of said blind bore of said valve bridge and thus extends into an outer recess on said control piston, and wherein an upper limit wall of said recess serves as said lower stop and delimits an extension stroke of said control piston.

18. An engine air brake device according to claim 15, wherein an upper one of said stops, which prescribes a retracted basic position for said control piston, is formed by a base of said blind bore in said valve bridge that forms said control pressure chamber and holds said control compression spring, wherein a central pin is disposed on a rear side of said control piston, wherein via a rear face of said pin said control piston contacts said base of said blind bore, wherein said base is provide with said relief duct so that said pin has the additional function that in each 4th engine stroke, immediately after a start of the camshaft-controlled opening-stroke movement of said valve bridge, and the resultant lifting of said valve bridge from said brace, the quantity of pressurized oil ejected via said relief duct for the purpose of relieving said control pressure chamber is limited since said relief duct is again closed by said pin of said control piston, which returns to its basic position immediately so that oil loss in said control pressure chamber can be limited and it can be ensured that oil pressure in said control pressure chamber remains high.

19. An engine air brake device according to claim 18, wherein said control compression spring is centered by said central pin on said control piston and is supported on the one hand on an annular shoulder base on said control piston and on the other hand on said base of said blind bore of said valve bridge.

* * * * *